United States Patent [19]

Ehrler et al.

[11] 3,979,895

[45] Sept. 14, 1976

[54] PINCH RING FOR YARN BALLOONS

[75] Inventors: Peter Ehrler; Adolf Seidel; Wolfgang Joas, all of Reutlingen, Germany

[73] Assignee: Institute fur Textil-und Faserforschung Stuttgart, Reutlingen, Germany

[22] Filed: Sept. 19, 1975

[21] Appl. No.: 614,972

[30] Foreign Application Priority Data

May 30, 1975 Germany ..... 2523939

[52] U.S. Cl. ..... 57/106; 57/108; 242/157 R

[51] Int. Cl.[2] ..... D01H 13/04; D01H 13/12

[58] Field of Search ..... 57/1 R, 34 R, 106, 107, 57/108, 109; 242/157 R

[56] References Cited

UNITED STATES PATENTS

| | | | |
|---|---|---|---|
| 3,065,592 | 11/1962 | Kresslein | 57/108 |
| 3,083,931 | 4/1963 | Dechene | 242/157 R |
| 3,084,500 | 4/1963 | Recher | 57/106 |
| 3,095,688 | 7/1963 | Russell | 57/106 |
| 3,269,104 | 8/1966 | Morita | 57/106 |
| 3,316,703 | 5/1967 | McKelvie | 57/106 |
| 3,863,433 | 2/1975 | Kanai | 57/108 X |
| 3,892,065 | 7/1975 | Kanai | 57/108 |

*Primary Examiner*—Donald E. Watkins
*Attorney, Agent, or Firm*—Edwin E. Greigg

[57] ABSTRACT

A pinch ring for the thread balloon of a spinning machine or twisting machine is substantially a single wire loop forming a spiral or helix. The ring may have overlapping end portions. The degree of overlap and the shape of the overlapping end portions as well as the pitch and the axial clearance between opposite points in the overlapping portions are all critical to the performance of the ring. The pinch ring defined by the invention permits substantially higher production rates without decreasing the rupture strength of the thread and provides a thread with substantially higher strength at standard production speeds.

23 Claims, 6 Drawing Figures

PINCH RING FOR YARN BALLOONS

BACKGROUND OF THE INVENTION

The invention relates to a pinch ring for controlling the shape of the so-called "thread balloon" in a spinning or twisting machine especially for use with threads which consist at least partially of modified polyester or polyacrylonitrile whose thread guide member is substantially a single helical loop with a smooth inner surface and a pitch which provides axial clearance between opposite thread guiding portions in adjacent windings of the loop.

The term "modified polyester or polyacrylonitrile fibers" refers to fibers which are so modified during manufacture that their longitudinal and lateral strength has been diminished so that these fibers will fracture more easily after repeated flexure. This feature prevents the formation of knots or similar accumulations during the processing of woven or knitted materials. Such accumulations would form unsightly small knots at the surface of the finished goods.

The balloon pinch rings which have been in use up to the present time permit only relatively low traveler speeds when used with yarns consisting at least partially of modified polyester or polyacrylonitrile fibers. These speeds are well below the traveler speeds usable with fibers of other compositions and this fact substantially reduces the production rate. The commonly used balloon pinch rings have a planar or helical loop (German Gebrauchsmuster 1380773); in the latter case the overlapping regions of the balloon pinch ring are separated by only a relatively small vertical clearance of approximately 2–3 mm.

It is also known to guard or confine the thread balloon over its entire height or a substantial portion of its height by means of a spiral wire cage (DT Pat. No. 169170, U.S. Pat. No. 2,660,856). Cages of this kind have not found any use in practice.

In order to reduce the damage to the thread, a known balloon pinch ring (DT Offenlegungsschrift 2242755) provides parallel ribs on at least part of the interior surface which comes in contact with the thread. These parallel ribs are disposed obliquely with respect to the passage of the thread. Manufacture of such a balloon pinch ring is quite complicated because the track for the thread is not smooth, but ribbed.

OBJECT AND SUMMARY OF THE INVENTION

It is one principal object of the invention to provide a balloon pinch ring of the type described above which permits substantially higher traveler speeds than those possible with any balloon pinch rings previously used in practice in a ring spinning machine for the manufacture of threads consisting at least partially of modified polyester or polyacrylonitrile fibers.

It is another object of the invention to provide a balloon pinch ring for the use in ring spinning machines which permits increasing the traveler speed without substantially increasing the thread breakage rate.

These and other objects of the invention are obtained by providing a balloon pinch ring in which overlapping portions of the loop are separated by at least 10 mm and in which the diameter of the helix defined by this loop changes along the longitudinal axis thereof.

When using balloon pinch rings of this type, an unexpected and surprising result is that threads consisting entirely or partly of modified polyester or polyacrylonitrile fibers can be wound up at substantially higher traveler speeds than has previously been possible. For example, when using a balloon pinch ring as defined by the invention, threads consisting of modified polyester fibers could be wound up without damage at traveler speeds of up to 34 meters per second, whereas previously known balloon pinch rings permitted a traveler speed of only 26 meters per second.

The balloon pinch ring according to the invention is also suitable for threads consisting of other fibers.

Preferably, it may be provided that the above referred-to clearance between overlapping portions in the loop of the novel balloon pinch ring is 14–30 mm, and preferably 16–20 mm. It is to be understood that clearances different from the above-cited ranges could be used suitably for particular rings and travelers, thread strengths, etc.

The thread guiding member of the balloon pinch ring according to the invention may be made of metal wire having a suitable profile and, if necessary, can be provided with a known surface treatment, for example it may be made of steel wire having a circular or oval cross section which may be burnished, chrome-plated, or the like. When elongated cross sectional profiles are used, for example oval profiles, the long axis may preferably be placed approximately parallel to the axis of the bobbin spindle. Other materials or cross sections could be used or, again, the thread-guide member could be made of sheet metal. If necessary, its cross section could change in the longitudinal direction of the thread guide member in any suitable manner whatever, for example it could continually increase from one end toward the other. The thread guide element may suitably be made of materials other than metal, for example of plastic or ceramic.

A preferred embodiment of the invention, which permits a particularly simple manufacture of the ring is, at the same time, suitable for achieving high traveler speeds. In this embodiment, the external envelope defined by the thread guide member is conical. However, the envelope may also be some other geometrical surface having substantially rotational symmetry, for example, it may have approximately the form of a parabola of rotation or a portion thereof.

The thread guide member may also, preferably, consist of a single filament, locally fixed within a holder, or of several untwisted, mutually parallel filaments. In this embodiment, the molecules of the filament are perferably oriented in the long direction of the filament which may, preferably, be synthetic. However, it might also be suitable to provide filaments of some other material, for example metal alloys which have acquired a preferred longitudinal direction by stretching.

Generally, it is sufficient and suitable if the thread guide member of the balloon pinch ring according to the invention extends over somewhat more than an angle of 360° about the axis of the associated bobbin spindle. However, the invention is not limited to this range and larger angles are usable. The improved thread characteristics which are derived from the pinch ring described above, defining the clearance between loop elements, can be still further enhanced by another embodiment of the invention which also defines the radial disposition of the ends of the pinch ring both individually and mutually. This embodiment takes account of the fact that thread damage is reduced if the passage of the thread from one wire winding to the other takes place as gently as possible. For this purpose the two ends of the thread guide member are so embodied that, after engaging one of the end regions of the loop, the thread leaves the other end of the loop smoothly and without shock. When used in a spinning machine, the last mentioned end region would point in the direction of the thread rotation. By embodying the ring in such a manner that, during each revolution, the thread leaves the thread guide member in a shock-free manner, the stability of the thread balloon is improved and the damage, especially to threads made of modified polyester or polyacrylonitrile fibers, is sharply reduced. In other words, the spindle rpm's may be further increased without thereby increasing the frequency of thread breakages due to damage induced by the balloon pinch ring.

The positional stability of the thread balloon being much improved by a pinch ring according to this embodiment, a collapse of the balloon occurs only under very extreme circumstances. Due to the very stable behavior of the thread balloon, the traveler also moves very smoothly, so that variations in the thread tension are thereby reduced. It is to be understood that the shockfree approach and release of the thread to and from the thread guide member are related to a thread balloon having a normal contour. During short periods of time, when the thread balloon is extremely deformed, for example if it is very soft or very rigid for a short period of time, i.e., when the tension of the thread forming the balloon is quite abnormal, the thread may no longer arrive or be released in a shock-free manner. But such extreme thread balloon conditions occur rarely and their frequency is further reduced by using the balloon pinch ring according to the present invention.

The term "shock-free release" of the thread from the balloon pinch ring means that the radial distance of the thread region which leaves the pinch ring, as measured from the longitudinal axis of the spindle, does not change abruptly when the thread leaves the ring. Instead, this radial distance remains constant or, at most, changes continuously without abrupt jumps, i.e., there shall be no radial accelerations of the thread which might result in a visible agitation of the balloon.

In general, the balloon pinch ring and the thread guide member may be one and the same element, namely a metal wire, preferably of circular cross section, whose diameter is just large enough to permit the element to have sufficient strength and stability. If necessary, the element may be plastic, having a suitably circular or other cross section. In many cases, the thread guide member may suitably also consist of a single filament or several untwisted, mutually parallel filaments which are inserted into a holder and whose molecules are preferably oriented in the longitudinal direction of the filament. Again, the thread guide member may be an interior protrusion of a larger ring, etc.

The structures which govern the behavior and the construction of the balloon pinch ring according to the invention are, of course, those surfaces at which the thread makes contact during its motion, so that, as has been previously discussed, the clearance between overlapping portions of the surfaces which guide the thread is also important. In the use of the balloon pinch ring according to the invention, it has been shown to be especially advantageous if the ring is so designed and located with respect to the spindle that, during a complete revolution of the thread, the point of contact between the thread and and the guide member travels axially in a direction opposite to the direction of propagation of the thread. However, the reverse arrangement may also be advantageous in many cases in which the end region of the loop which points in the direction of rotation of the thread would be the lower-placed end region.

It is to be understood that the shock-free approach to and the shock-free release of the thread from the ring can be maintained only for certain ranges of thread tension and cannot be maintained when these tensions are extremely high or low which might happen for short periods of time. However, to maintain shock-free approach down to very low thread tensions, it may be suitable to extend somewhat, in a tangential direction, that end of the ring adjacent to the point of first contact of the thread. A similar construction may be used for the end of the ring adjacent to the point of first release of the thread. These constructions permit shock-free engagement and disengagement down to very low thread tension values. The first cited construction also enhances the shock-free release since the release occurs later than the approach and if, under extreme conditions of thread tension, the thread does not engage the ring shocklessly, the balloon is set into motion, which would also disturb the shock-free release of the thread from the ring.

Advantageously, the balloon pinch ring is so designed that the thread guide member of the ring is in contact with the thread over an angle of at most 30° when the thread balloon has a normal configuration. This brings the advantage that, during its complete revolution, the thread is in contact with two staggered positions of the thread guide member only over a relatively small angle whereas, during the remainder of the revolution it touches only a single point of the member and this fact further reduces damage to the thread fibers. It is particularly useful to hold this angular region as small as possible but it must be considered that, the smaller the angle in which the thread contacts both end regions of the thread guide member, the smaller is the range of thread tension within which shock-free engagement and disengagement of the thread from the member can be maintained. A very favorable compromise between these opposing conditions can be achieved by so embodying the thread guide member that, when the thread balloon has a normal configuration, only an angular sector of the circumference of the balloon of from 2° to 15° makes contact with both ends of the thread guide. The maintenance of shock-free engagement and disengagement of the thread from the balloon during an especially wide range of thread tension has been achieved by providing that the regions of the ring in which engagement and disengagement take place are substantially straight and substantially tangential to the envelope of the balloon. Again, it may be suitable to provide a convex region adjacent to one of the straight regions referred to above and lying in the direction of the opposite end of the ring. The disposition of the convex region may be especially suitable in that end region in which the thread disengages from the ring. In some other cases, it may be suitable to make this region concave.

The curvature of the ring may suitably be such that the point on the end region from which the thread disengages constitutes a point of inflection of curvature, located just above that point on the other end region at which the thread first makes contact with the ring.

This construction insures shock-free release of the thread when the thread makes contact with both end regions of the ring only within a very narrow angular sector.

The shock-free engagement and disengagement of the thread is further enhanced in an embodiment in which the substantially tangential portions of the thread guide member begin in the same radial plane and extend in opposite directions. It may also be suitably provided that the angle between the ends of the tangential region as measured along the thread guide member is between 355° to 365°, and is preferably approximately 360°.

In order to permit easy threading of the thread into the balloon pinch ring, it is generally desirable to have as little overlap of the end regions of the ring as possible. However, an opposing criterion is that, in order to maintain shock-free engagement and disengagement of the thread within a relatively wide range of thread tensions, some overlap is unavoidable. A particularly favorable compromise is achieved by providing that the angular distance between the two ends of the member is approximately 400° to 430°.

The invention will be better understood, as well as further objects and advantages thereof will become more apparent from the following detailed description of preferred, although exemplary embodiments, taken in conjunction with the drawing.

DESCRIPTION OF THE PREFERRED EMBODIMENTS OF THE INVENTION

Figure 1:
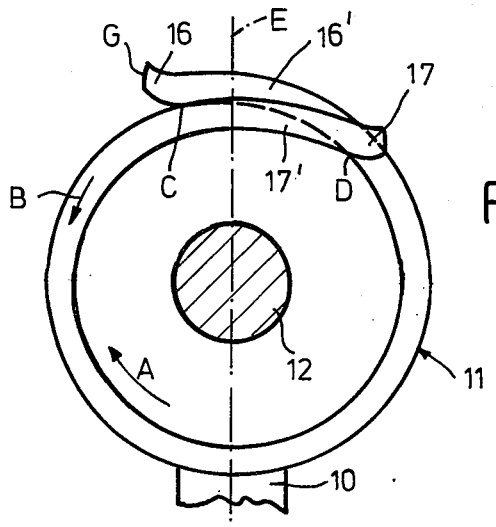
FIG. 1 is a top view of a first exemplary embodiment of a balloon pinch ring according to the invention which also shows the cross section of the associated spindle in the plane of the ring.
Figure 2:
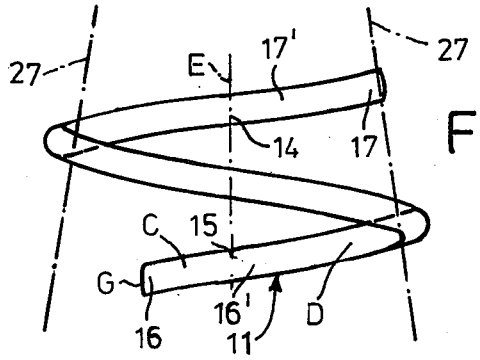
FIG. 2 is a side view of the pinch ring of FIG. 1, the spindle being omitted in this figure.

The balloon pinch ring illustrated in FIGS. 1 and 2 includes a partially shown holder 10 and, fastened thereto a metal thread guide member 11 formed from wire of circular cross section. This thread guide member 11 extends around the longitudinal axis of the associated spinning spindle 12 over an angular sector of approximately 450°. The direction of rotation of the thread in the thread balloon is indicated by the arrow A and, in this exemplary embodiment as seen from above, is clockwise. As may be seen from the drawing the handedness or helicity of the thread guide member 11 (arrow B) as seen from above is opposite to that of the thread direction A, i.e., as seen from above, it is counterclockwise in the sense that elements of the ring recede from the observer when traveling along the helix in the counterclockwise direction. This is particularly advantageous; however, the invention is not limited to this embodiment because it is also possible to provide a thread guide member whose handedness is the same as the direction of thread in the balloon. In such a case, however, it is suitable, in general, to make the clearance between the overlapping windings of the thread guide member somewhat larger than would be the case when the directions are in the opposite sense.

As may be seen especially clearly from FIG. 2, the pitch of the thread guide member 11 is taken to be so large that two locations 14, 15 of the thread guide member which lie above one another in the same vertical plane and on the same side of the spindle 12 have a relatively large clearance, which, in this preferred exemplary embodiment, is approximately 20 mm.

In known manner, the two ends 16, 17 of the thread guide member 11 are bent outwardly somewhat to facilitate insertion of the thread.

In this exemplary embodiment the lower end region 16' of the thread guide member 11 is the region on which the thread first engages the ring and FIG. 1 shows clearly that the disposition of this end region 16' with respect to the end region 17' lying above it, insures that the rotating thread engages the lower end region 16' in a shock-free manner. In addition, it should be considered that the thread balloon is narrowed by the balloon pinch ring and, therefore, the rotating thread, while gliding along the two overlapping regions 16', 17' of the member 11, reaches the lower end region 16' some distance prior to reaching the location D. The location D is a crossing point, which seen from above, is the point of intersection of the interior surface of the lower end region 16' and the interior surface of the upper end region 17'. The point on the lower end region 16' first contacted by the rotating thread depends on the thread tension, and the lower end region 16', which is concave as seen from the spindle axis, is so chosen that under all normally occurring thread tensions, the thread always engages the lower end region 16' between points C and D and this occurs in a shock-free manner. If, on the other hand, the thread were to impinge on the lower end region between the location G (the free end) and the point C, the engagement would not be shock-free. Thus, the radial distance of point C from the spindle axis must be so chosen that, for normally occurring thread tension, the rotating thread does not arrive ahead of this point C, i.e., does not arrive in the region G-C of the thread guide member. The balloon pinch ring shown in FIGS. 1 and 2 is an actual scale drawing of a balloon pinch ring tested in practice.

In many cases, it is sufficient to provide a single balloon pinch ring of this type for each spinning spindle. However, in known manner, several of these rings can be disposed at axial distances from another, one on top of the other.

The spiral thread guide member 11 shown in FIGS. 1 and 2 is formed in such a manner that its external envelope is substantially a geometrical cone, which is indicated by the dash-dot line 27 in FIG. 2. Accordingly, the radial distance of any part of the thread guide member 11 from the longitudinal axis of the spindle 12 increases in the downward direction as seen in the figure. The shock-free engagement and release of the thread with and from the ring is further enhanced by an embodiment shown in FIG. 3 which again shows the thread guide member 11 consisting of metal wire of round cross sections whose diameter is that of customary balloon pinch rings. The thread engages the region 16' of this member 11 once during each complete revolution. The clearance between this region 16' and the region 17' vertically above it is approximately 10 mm, preferably at least 14 mm. It has been found to be particularly favorable if this clearance is 14–30 mm and preferably 16–20 mm, as already described above.

The thread guide member 11 has a single complete winding extending from the free end 31 to the free end 32 and, in this preferred exemplary embodiment, the angular sector between the two ends is approximately 430°. The radial distance of elements of the thread guide member 11 from the axis 12', belonging to an associated spinning spindle not shown in greater detail, increases continuously beginning at the top free end 32 down to the lower free end 31. Two points on the ring lying in the common vertical meridian plane 30, define a line lying on a conical cylinder within which the ring extends substantially spirally over an angular sector of 360°.

Figure 3:
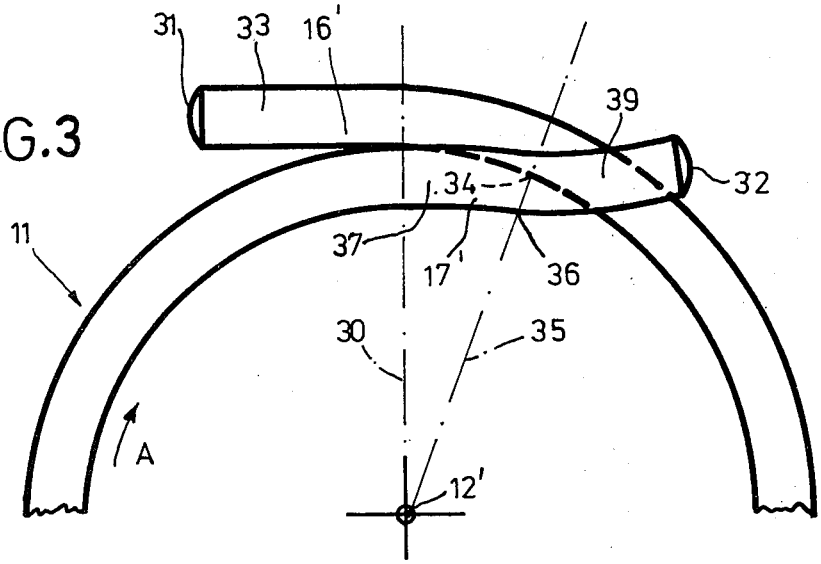
FIG. 3 is a top view of a balloon pinch ring according to a second exemplary embodiment showing only adjacent ends.

The thread guide member 11 according to the embodiment of FIG. 3 is so located that the thread of the thread balloon rotates in the direction of the arrow A so that, during each revolution, the thread disengages once from the upper end region 17' and engages once at the lower end region 16' of the member 11. These two end regions 16', 17' are so formed and located that the engagement of the thread occurs smoothly, without jumps, even over a very wide range of thread tension. Therefore, the form of the thread balloon and the thread tension may be varied considerably without thereby affecting the shock-free engagement and the smooth release of the thread, thus achieving a particularly stable thread balloon. Only during very temporary extreme conditions of the thread balloon would the stability of the balloon be disturbed. However, such extreme conditions are rare and are always short term events; moreover, their frequency of occurrence is reduced because the balloon pinch ring according to the present invention tends to prevent them.

The terminal region 33 of the ring which begins at the meridian plane 30 and extends toward the tip 31 of the thread guide element 11 is straight and lies substantially tangential to a normal thread balloon. During operation, the thread normally engages this straight tangential region 33, thus being already in contact with the lower end region 16' when it passes the meridian plane 30. However, when the thread tension is very high, possibly while the thread balloon is very short, it can happen that the thread makes contact only after passing the meridian plane 30, i.e., on the right side of the plane 30 as seen in FIG. 1, and engages an already curved part of the thread guide member 11; this part normally extends approximately up to a point 34, lying in a meridian plane 35. At a point lying in this meridian plane 35, the end region 17' which serves for the discontinuity-free release of the thread, has a point of inflection 36; this construction having been shown to be particularly advantageous. The upper end region 17', from which the thread disengages smoothly within a very wide range of thread tension values, begins, as viewed in the direction of thread rotation A, on the right side of meridian plane 30 and extends approximately to the meridian plane 35; under normal circumstances it includes an angular sector of less than 15'. In the region between the two meridian planes 30 and 35, this upper end region 17' is nearly straight or, as seen from the spindle axis, very slightly concave, but the radii of curvature are substantially greater here than are those obtaining in the angular sector of 360° extending from one side of the meridian plane 30 to the other. Beginning at the right side of the plane 35, i.e., at the point of inflection 36, the region 39 of the ring which terminates in the free end 32 is convex as seen from the spindle axis, i.e., it is bent outwardly and this is particularly advantageous.

Figure 4:
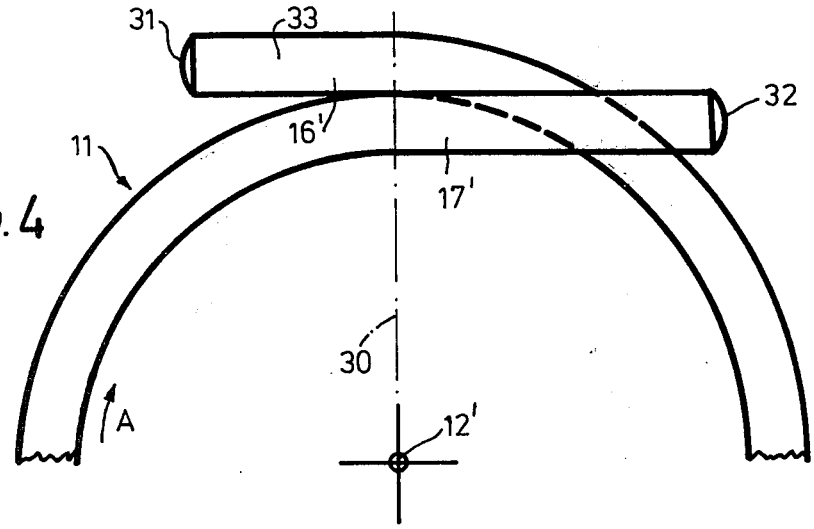
FIG. 4 is a variant of the embodiment shown in FIG. 3.

Yet another preferred embodiment of the invention is shown in FIG. 4. In this figure, the balloon pinch ring 11 is similar to that shown in FIG. 3 except for the end region 17' starting at the meridian plane 30. In this case, the end region 17' is straight from the meridian plane 30 up to the free end 32 and it is tangential to a thread balloon as formed in normal operation.

In normal operation, during each revolution, the thread engages the lower end region 16' once in a shock-free manner and shortly thereafter disengages smoothly from the upper end region 17'.

The rings shown in FIGS. 3 and 4 are drawn to enlarged scale. Both rings have produced extraordinarily good results so that any detail which can be derived from the figures would be suitable and advantageous to the user. These rings permit spinning threads consisting of modified polyester firbers or polyacrylonitrile fibers while using traveler speeds such as cannot, even remotely, be achieved with known balloon pinch rings. They are able to perform in this manner because they considerably reduce the danger of thread damage or postpone such damage until considerably higher traveler speeds are reached. Furthermore, these rings result in a very quiet and stable thread balloon with all of the advantages deriving therefrom, in spite of the large clearance between the end regions 16, 17'. Furthermore, the form and shape of the thread balloon, as well as the thread tension may vary between wide limits without thereby destroying the shock-free manner of engagement and the smooth and discontinuity-free release of the thread. The rings 11, shown in FIGS. 3 and 4, were subjected to experiment; their vertical clearances were approximately 17-18 mm.

Figure 6:
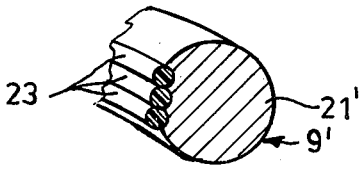
FIG. 6 is a second variant of the embodiments of the invention in which the thread guide surface is formed by several filaments.
Figure 5:
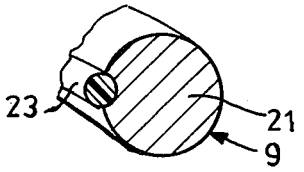
FIG. 5 is a cross section through a portion of a first variant of the ring in which the thread guide surface of the member is formed by a plastic filament.

In many cases, especially when higher traveler speeds are desired, it is advantageous to form the thread guide member by one or several filaments whose molecules are preferentially oriented in the longitudinal direction of the filament. These filaments can be made preferably of stretched plastic. Two exemplary embodiments are shown in FIGS. 5 and 6. Both figures show a cross-sectional portion of a balloon pinch ring 9 or 9'. This ring 9 or 9', which is not shown in detail, could be helical, for example like the thread guide member 11 of FIGS. 1 and 2. Each of the rings 9, 9' has a spiral carrier body 21, 21', respectively, which, in this case, is made of profiled metal wire whose inside surface has one or three longitudinal grooves, respectively, which extend in the long direction of the wire and are parallel to its central axis. Each of these grooves contains a round filament 23 which is firmly seated therein. The filament 23 may preferably consist of a synthetic material exhibiting low friction and this material may suitably be a high polymer plastic. The material may be stretched so that the fiber molecules are pre-oriented in the long direction of the filament. Materials which are particularly suitable are olefin polymers, preferably polyethylene and polypropylene or polyfluoroethylene compounds, preferably polytetrafluoroethylene or polytrifluoroethylene.

What is claimed is:

1. A guide and pinch ring for thread balloons in spinning and twisting machines, comprising:

a thread guide member with windings defining a helix having a single complete loop, said windings having different radii and smooth thread-guiding surfaces, the pitch of said helix being such that said thread-guiding surfaces of adjacent ones of said windings are separated by at least 10 mm;

whereby the thread which revolves in the interior of the ring engages and disengages said thread-guiding surfaces of the windings in a smooth and shock-free manner.

2. A guide and pinch ring as claimed in claim 1, wherein the thread guiding surfaces of adjacent ones of said windings are separated by 14–30 mm.

3. A guide and pinch ring as claimed in claim 1, wherein the thread guiding surfaces of adjacent ones of said windings are separated by 16–20 mm.

4. A guide and pinch ring as claimed in claim 1, wherein said helix has a gometrical envelope defining a body of revoltution is a cone.

5. A guide and pinch ring as claimed in claim 4, wherein said body of revolution is a cone.

6. A guide and pinch ring as claimed in claim 4, wherein said body of revolution is a paraboliod of revolution.

7. A guide and pinch ring as claimed in claim 1, wherein said thread guide member is constructed from a strand of material of circular cross section.

8. A guide and pinch ring as claimed in claim 1, wherein said thread guide member is constructed from a strand of material of oval cross section.

9. A guide and pinch ring as claimed in claim 1, wherein said thread guide member is constructed from a strand of material whose cross section changes with length.

10. A guide and pinch ring as claimed in claim 1, wherein said thread guide member is constructed of wire.

11. A guide and pinch ring as claimed in claim 1, wherein said thread guide member is constructed of a strand of synthetic material.

12. A guide and pinch ring as claimed in claim 1, wherein one end of said thread guide member extends beyond said helix in a substantially tangential direction relative to the geometrical surface thereof.

13. A guide and pinch ring as claimed in claim 1, wherein both ends of said thread guide member extend beyond said helix in a substantially tangential direction relative to the geometrical surface thereof.

14. A guide and pinch ring as claimed in claim 1, wherein the beginnings of said thread guiding surfaces are straight and tangential to the geometrical surface of said helix.

15. A guide and pinch ring as claimed in claim 14, wherein a portion of one of said windings adjacent to at least one of said straight beginnings of said thread guiding surfaces is curved and has a positive radius of curvature.

16. A guide and pinch ring as claimed in claim 14, wherein a portion of one of said windings adjacent to at least one of said straight beginnings of said thread guiding surfaces is curved and has a negative radius of curvature.

17. A guide and pinch ring as claimed in claim 1, wherein at least one of said thread guiding surfaces has a point of inflection of curvature, said point of inflection being located in the same meridian plane of said helix as the endpoint of the other one of said thread guiding surfaces located on an adjacent winding.

18. A guide and pinch ring as claimed in claim 1, wherein the angle measured from one end of said thread guide member, around the axis of said helix, along said windings, is approximately 400° – 430°.

19. A guide and pinch ring as claimed in claim 1, wherein both ends of said thread guide member are substantially straight and extend beyond said helix substantially tangentially to the geometrical surface thereof and begin in one and the same meridian plane of said helix.

20. A guide and pinch ring as claimed in claim 19, wherein the angle measured from the onset of said straight ends of said thread guide member, measured around the axis of said helix, along said windings, is approximately 335° – 365°.

21. A guide and pinch ring as claimed in claim 1, wherein said thread guide member is provided with at least one filament, which includes said thread guiding surfaces and which is affixed to the inside surface of said thread guide member, with its long axis parallel to the long axis of said thread guide member.

22. A guide and pinch ring as claimed in claim 21, wherein said at least one filament is a plurality of at least three filaments.

23. A guide and pinch ring as claimed in claim 21, wherein said at least one filament is made from a high-polymer synthetic material.

* * * * *

UNITED STATES PATENT OFFICE

CERTIFICATE OF CORRECTION

Patent No. 3,979,895 Dated September 14, 1976

Inventor(s) Peter Ehrler, Adolf Seidel, Wolfgang Joas

It is certified that error appears in the above-identified patent and that said Letters Patent are hereby corrected as shown below:

Col. 6, line 66, "sections" should be --section--;

Col. 7, line 63, "15'" should be --15°--;

Col. 9, line 18, "gometrical" should be --geometrical-- line 19, "revoltution is a cone." should be --revolution.-- line 23, "paraboliod" should be --paraboloid--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*